US006615440B1

(12) United States Patent
Williams

(10) Patent No.: US 6,615,440 B1
(45) Date of Patent: Sep. 9, 2003

(54) PLUMBING SNAKE DIVERTING APPARATUS

(76) Inventor: La Vaughn A. Williams, 3608 Princeton Ave., San Diego, CA (US) 92117

( * ) Notice: Subject to any disclaimer, the term of this patent is extended or adjusted under 35 U.S.C. 154(b) by 0 days.

(21) Appl. No.: 09/965,725

(22) Filed: Sep. 27, 2001

(51) Int. Cl.[7] ..... B08B 9/043; B08B 13/00
(52) U.S. Cl. ..... 15/257.01; 15/104.33
(58) Field of Search ..... 15/1, 104.001, 15/104.05, 104.16, 104.31–104.33, 257.01; 254/134.3 FT

(56) References Cited

U.S. PATENT DOCUMENTS 566,110 A * 8/1896 Wrigley ..... 15/104.33
1,751,415 A * 3/1930 McCaffrey ..... 15/104.33
1,824,924 A * 9/1931 Paul et al. ..... 15/104.33
2,819,480 A * 1/1958 Kollmann ..... 15/104.33
2,973,537 A * 3/1961 Simpson ..... 15/104.33
3,160,904 A * 12/1964 Swanson ..... 15/104.31
3,958,293 A 5/1976 Irwin ..... 15/104.33
4,232,419 A 11/1980 Sanger ..... 15/104.33
4,692,957 A 9/1987 Kovacs ..... 15/104.33
4,771,500 A 9/1988 Kovacs ..... 15/104.33
4,974,280 A * 12/1990 Ward ..... 15/257.01
5,018,234 A 5/1991 Meyer et al. ..... 15/104.33
6,098,212 A 8/2000 Rogan ..... 4/255.04

* cited by examiner

*Primary Examiner*—Mark Spisich

(57) ABSTRACT

A plumbing snake diverting apparatus for deflecting a plumbing snake out of a main stack pipe and into a secondary pipe extending from the main stack pipe. The plumbing snake diverting apparatus includes an tubular extension member which is selectively couplable to any number of curved, tubular diverting members depending on the size of the pipe. The apparatus is then positioned with a leading edge of the diverting member at the intersection of the main stack pipe and the pipe to be cleared. The plumber's snake is then deflected into the secondary pipe upon insertion.

7 Claims, 2 Drawing Sheets

PLUMBING SNAKE DIVERTING APPARATUS

BACKGROUND OF THE INVENTION

1. Field of the Invention

The present invention relates to plumbing tools and more particularly pertains to a new plumbing snake diverting apparatus for deflecting a plumbing snake out of a main stack pipe and into a secondary pipe extending from the main stack pipe.

2. Description of the Prior Art

The use of plumbing tools is known in the prior art. U.S. Pat. No. 4,692,957 describes a device/system for clearing obstructions in pipes where bends are encountered. Another type of plumbing tools is U.S. Pat. No. 5,018,234 having an auger device with an attachment allowing the user to attach a power tool.

While these devices fulfill their respective, particular objectives and requirements, the need remains for a device/system/method that includes/is superior/ has certain improved features that allow the user to clear pipes that divert from the main vent pipe utilizing a standard plumber's snake.

SUMMARY OF THE INVENTION

The present invention meets the needs presented above by utilizing a combination of tubular members to access the pipes to be cleared by entering the main vent pipe and proceeding down through until the diverted pipe is found, thereafter a snake is used to clear the drain.

Still yet another object of the present invention is to provide a new plumbing'snake diverting apparatus that allows the user to enter the plumbing system from the roof vent.

Even still another object of the present invention is to provide a new plumbing snake diverting apparatus that is adaptable to any size of pipes by the use of multiple adaptors.

To this, the present invention generally comprises an tubular extension member which is selectively couplable to any number of curved, tubular diverting members depending on the size of the pipe. The apparatus is then positioned with a leading edge of the diverting member at the intersection of the main stack pipe and the pipe to be cleared. The plumber's snake is then deflected into the secondary pipe upon insertion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
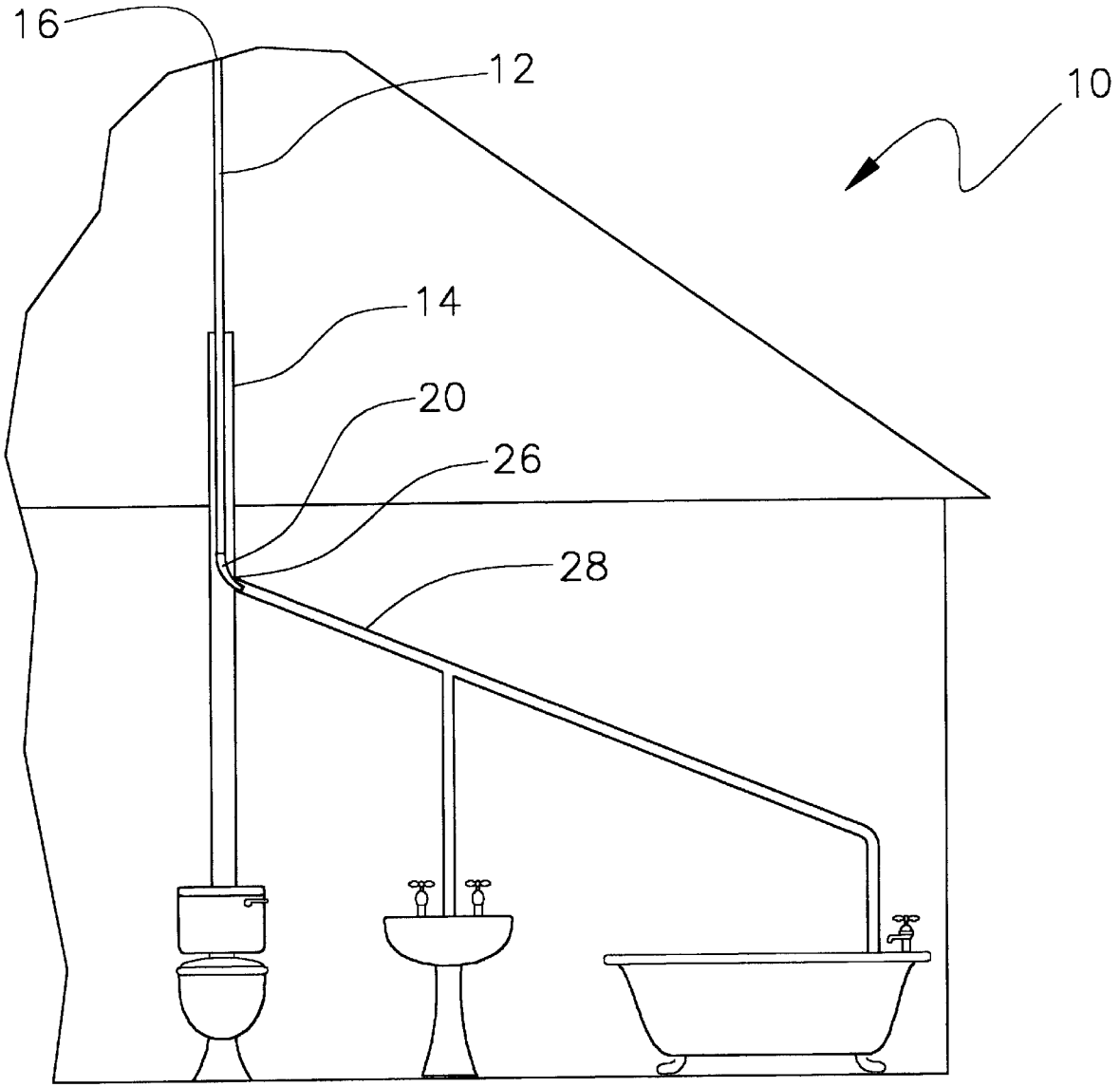
FIG. 1 is a schematic front view of a new plumbing snake diverting apparatus according to the present invention.
Figure 2:
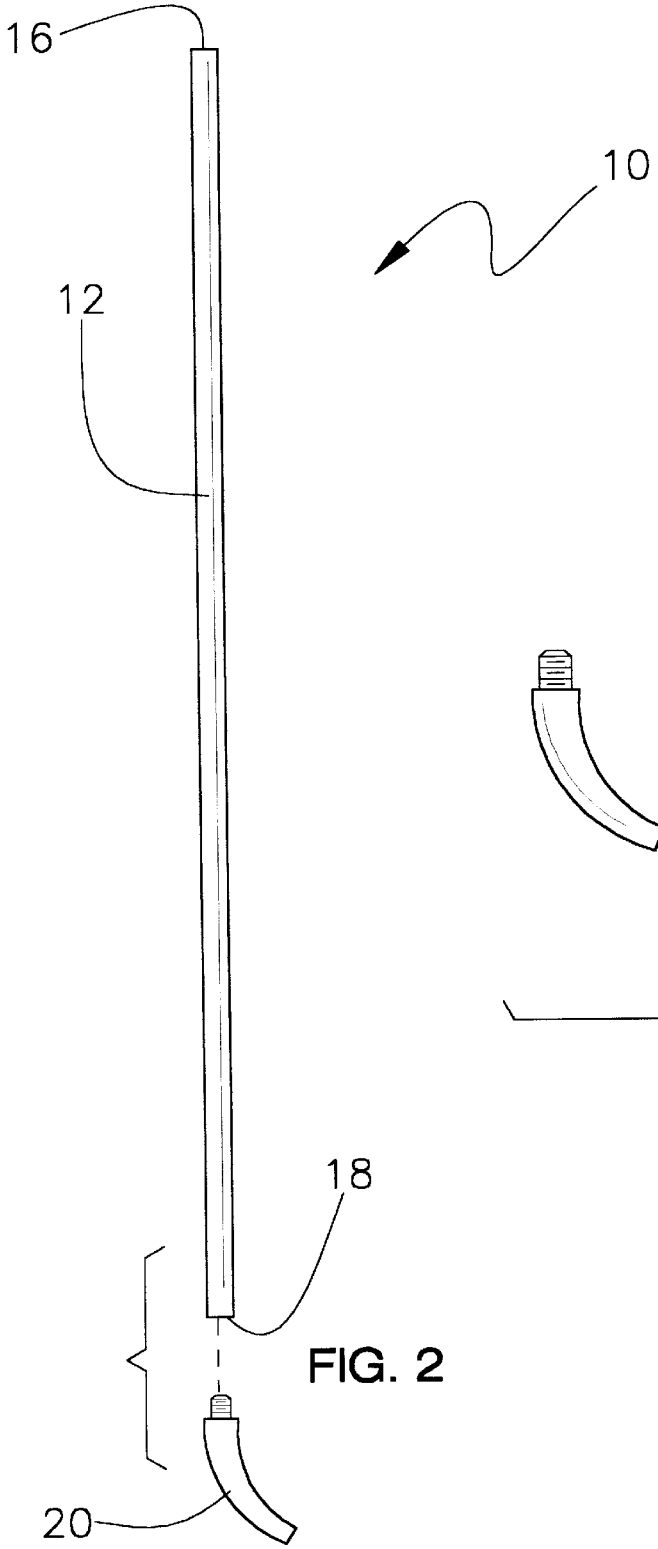
FIG. 2 is a schematic side view of the present invention.
Figure 3:
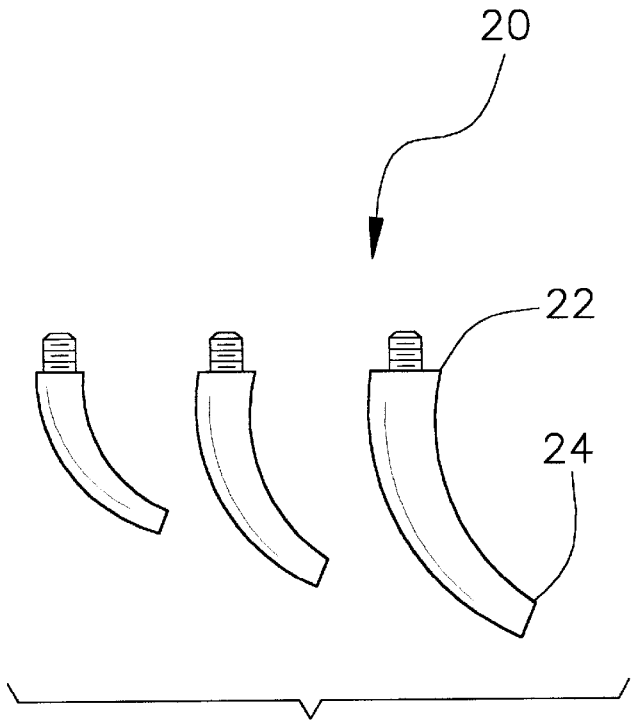
FIG. 3 is a schematic side view of the different sizes of diverting members of the present invention.

With reference now to the drawings, and in particular to FIGS. 1 through 3 thereof, a new plumbing snake diverting apparatus embodying the principles and concepts of the present invention and generally designated by the reference numeral 10 will be described.

As best illustrated in FIGS. 1 through 3, the plumbing snake diverting apparatus 10 generally comprises an extension member 12. The extension member 12 is for inserting into a stack pipe 14 of a building. The extension member 12 is an elongate tubular member. The extension member 12 has an open end 16 and a coupling end 18. An inside diameter of the extension member 12 is large enough such that the plumber's snake is insertable therethrough.

Also included is a plurality of diverting members 20. Each of the diverting members 20 is a tubular member. Each of the diverting members 20 has a trailing end 22 and a leading end 24. Both of the ends 22, 24 are open such that the plumber's snake is passable through the trailing end 22 and exiting the leading end 24.

The diverting members 20 are arcuate between the trailing and trailing ends 22, 24 with a radius of curvature such that the plumber's snake exits the leading end 24 at an angle from a longitudinal axis of the extension member 12 when the trailing end 22 is coupled to the coupling end 18 of the extension member 12.

A width of the diverting members 20 is substantially smaller than an inside diameter of the main stack pipe 14 such that the diverting members 20 are insertable downwardly into the main stack pipe 14 when coupled to the extension member 12.

Each of the diverting members 20 has a width corresponding to a specific size main stack pipe 14 for facilitating insertion of the leading end 24 of the diverting members 20 into a connection portion 26 between the main stack pipe 14 and the secondary pipe 28 thereby permitting the plumber's snake to enter the secondary pipe 28 for the purpose of clearing out the pipe.

The width of the diverting members 20 is defined as the largest cross-sectional measurement taken perpendicular to the longitudinal axis of the extension member 12 when coupled to the extension member 12.

A coupling means for removably coupling each of the plurality of diverting members 20 to the extension member 12. The coupling means are located on the coupling end 18 of the extension member 12 and the trailing end 22 of the diverting members 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plumbing snake diverting apparatus for deflecting a plumbing snake out of a main stack pipe and into a secondary pipe that extends from the main stack pipe, the plumbing snake diverting apparatus comprising:

an extension member, said extension member being for inserting into a stack pipe of a building, said extension member being an elongate tubular member, an inside diameter of said extension member being large enough such that the plumbers snake is insertable therethrough;

a plurality of diverting members, a width of said diverting members being substantially smaller than an inside diameter of the main stack pipe such that said diverting members being insertable downwardly into the main stack pipe when coupled to said extension member;

each of said diverting members having a trailing end and a leading end, both of said ends being open such that the plumber's snake is passable through said trailing end and exiting said leading end; and said diverting members being arcuate between said leading and trailing ends with a radius of curvature such that the plumbers snake exits said leading end at an angle from a longitudinal axis of said extension member when said trailing end is coupled to said extension member, said diverting members tapering from said trailing end to said leading end to facilitate insertion of said leading end of said diverting members into the secondary pipe extending from the main stack pipe.

2. The plumbing snake diverting apparatus as set forth in claim 1, further comprising:

said extension member having an open end and a coupling end.

3. The plumbing snake diverting apparatus as set forth in claim 1 further comprising:

each of said diverting members being a tubular member.

4. The plumbing snake diverting apparatus as set forth in claim 1, further comprising:

each of said diverting members having a width corresponding to a specific size main stack pipe for facilitating insertion of said in leading end of said diverting members into a connection portion between the main stack pipe and the secondary pipe thereby permitting the plumber's snake to enter the secondary pipe for the purpose of clearing out the pipe.

5. The plumbing snake diverting apparatus as set forth in claim 4, wherein the width of the diverting members is defined as the largest cross-sectional measurement taken perpendicular to the longitudinal axis of said extension member when coupled to said extension member.

6. The plumbing snake diverting apparatus as set forth in claim 1, further comprising:

a coupling means for removably coupling each of said plurality of diverting members to said extension member, said coupling means being located on said extension member and said trailing end of said diverting members.

7. A plumbing snake diverting apparatus for deflecting a plumbing snake out of a main stack pipe and into a secondary pipe that extends from the main stack pipe, the plumbing snake diverting apparatus comprising:

an extension member, said extension member being for inserting into a stack pipe of a building, said extension member being an elongate tubular member, said extension member having an open end and a coupling end, an inside diameter of said extension member being large enough such that the plumber's snake is insertable therethrough;

a plurality of diverting members, each of said diverting members being a tubular member, each of said diverting members having a trailing end and a leading end, both of said ends being open such that the plumber's snake is passable through said trailing end and exiting said leading end, said diverting members being arcuate between said leading and trailing ends with a radius of curvature such that the plumbers snake exits said leading end at an angle from a longitudinal axis of said extension member when said trailing end is coupled to said coupling end of said extension member, said diverting members tapering from said trailing end to said leading end to facilitate insertion of said leading end of said diverting members into the secondary pipe extending from the main stack pipe, a width of said diverting members being substantially smaller than an inside diameter of the main stack pipe such that said diverting members being insertable downwardly into the main stack pipe when coupled to said extension member, each of said diverting members having a width corresponding to a specific size main stack pipe for facilitating insertion of said leading end of said diverting members into a connection portion between the main stack pipe and the secondary pipe thereby permitting the plumber's snake to enter the secondary pipe for the purpose of clearing out the pipe;

wherein the width of the diverting members is defined as the largest cross-sectional measurement taken perpendicular to the longitudinal axis of said extension member when coupled to said extension member; and a coupling means for removably coupling each of said plurality of diverting members to said extension member, said coupling means being located on said coupling end of said extension member and said trailing end of said diverting members.

* * * * *